US007378789B2

(12) United States Patent
Jeon et al.

(10) Patent No.: US 7,378,789 B2
(45) Date of Patent: May 27, 2008

(54) ELECTRON EMISSION DEVICE

(75) Inventors: Sang-Ho Jeon, Suwon-si (KR); Chun-Gyoo Lee, Suwon-si (KR); Sang-Jo Lee, Suwon-si (KR); Sang-Hyuck Ahn, Suwon-si (KR); Su-Bong Hong, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 215 days.

(21) Appl. No.: 11/378,445

(22) Filed: Mar. 16, 2006

(65) Prior Publication Data

US 2006/0220524 A1 Oct. 5, 2006

(30) Foreign Application Priority Data

Mar. 31, 2005 (KR) ..... 10-2005-0026870

(51) Int. Cl.
*H01J 1/62* (2006.01)

(52) U.S. Cl. ..... 313/495; 313/414

(58) Field of Classification Search ..... 313/409, 313/414, 495, 497

See application file for complete search history.

(56) References Cited

U.S. PATENT DOCUMENTS 5,955,850 A 9/1999 Yamaguchi et al.

FOREIGN PATENT DOCUMENTS

EP 1 429 363 A2 6/2004
EP 1 429 363 A3 6/2006

OTHER PUBLICATIONS

European Search Report dated Aug. 22, 2006, for EP 06112052.3, in the name of Samsung SDI Co., Ltd.

*Primary Examiner*—Vip Patel
(74) *Attorney, Agent, or Firm*—Christie, Parker & Hale, LLP

(57) ABSTRACT

An electron emission device includes a first substrate; a second substrate facing the first substrate and spaced apart from the first substrate; an electron emission unit on the first substrate, the electron emission unit having at least two electrodes and an emission region for emitting electrons; and a light emission unit on the second substrate to be excited by a beam formed with the electrons. The electron emission unit includes a focusing electrode for focusing the beam. The light emission unit includes a screen on which pixels are arranged in a pattern. Each of the pixels has a phosphor layer. The phosphor layer of one of the pixels is excited by the beam. The focusing electrode includes an opening, through which the beam passes. A length of the opening is $L_V$, a pitch of a pixel is $P_V$, and $L_V$ and $P_V$ satisfy: $0.25 \leqq L_V/P_V \leqq 0.60$.

16 Claims, 9 Drawing Sheets

ELECTRON EMISSION DEVICE

CROSS-REFERENCE TO RELATED APPLICATION

This application claims priority to and the benefit of Korean Patent Application No. 10-2005-0026870, field on Mar. 31, 2005 in the Korean Intellectual Property Office, the entire content of which is incorporated herein by reference.

BACKGROUND OF THE INVENTION

1. Field of the Invention

The present invention relates to an electron emission device, and, more particularly, to an electron emission device in which a size of a beam-passing opening is set within a range in response to a vertical pitch of a pixel to minimize (or reduce or prevent) electron beams from striking and exciting unwanted pixels in a vertical direction, thereby improving the uniformity of the resolution.

2. Description of Related Art

An electron emission device (e.g., a field emitter array (FEA) device, a ballistic electron surface (BSE) device, a surface conduction emission (SCE) device, a metal-insulator-metal (MIM) type device, and a metal-insulator-semiconductor (MIS) device, etc.) includes first and second substrates facing each other. Electron emission regions are formed on the first substrate. Cathode and gate electrodes functioning as driving electrodes for controlling the emission of electrons from the electron emission regions are also formed on the first substrate. Formed on a surface of the second substrate facing the first substrate are a phosphor screen and an anode electrode for placing the phosphor screen in a high potential state.

The first and the second substrates are sealed together at their peripheries using a sealing material such as frit, and the inner space between the substrates is exhausted to form a vacuum chamber (or a vacuum vessel). Arranged in the vacuum vessel are a plurality of spacers for uniformly maintaining a gap between the first and second substrates.

The typical electron emission device further includes a focusing electrode for focusing the electron beams from the electron emission regions. The focusing electrode is spaced apart from the gate electrode with a gap (which may be predetermined) therebetween. That is, the focusing electrode is spaced apart from the gate electrode.

The focusing electrode is provided with a plurality of beam-passing openings corresponding to pixels of the phosphor screen. That is, the size of each beam-passing opening may be designed to be identical to each corresponding pixel.

However, when the electron beam reaches a target pixel via the beam-passing opening, a size of the electron beam reaching the target pixel may be greater than that of the target pixel. In this case, the beam may strike the target pixel and an unwanted pixel adjacent to the target pixel, thereby exciting the unwanted pixel.

Therefore, a degree of luminescence from the target pixel is lowered, and thus the overall resolution of the phosphor screen is deteriorated.

SUMMARY OF THE INVENTION

An aspect of the present invention provides an electron emission device in which a size of a beam-passing opening formed on a focusing electrode is dimensioned to minimize (or reduce or prevent) an electron beam passing through the beam-passing opening from exciting an unwanted pixel.

In an exemplary embodiment of the present invention, an electron emission device includes a first substrate; a second substrate facing the first substrate and spaced apart from the first substrate; an electron emission unit formed on the first substrate, the electron emission unit having a first electrode, a second electrode, and an electron emission region for emitting electrons; and a light emission unit formed on the second substrate and adapted to be excited by an electron beams formed with the electrons. The electron emission unit includes a focusing electrode for focusing the electron beam; the light emission unit includes a phosphor screen on which a plurality of pixels are arranged in a pattern, each of the pixels having a phosphor layer, the phosphor layer of at least one of the pixels being adapted to be excited by the electron beam; and the focusing electrode includes a beam-passing opening, through which the electron beam passes, and, when a vertical length of the beam-passing opening is $L_V$ and a vertical pitch of at least one of the pixels is $P_V$, the vertical length $L_V$ and the vertical pitch $P_V$ satisfy: $0.25 \leqq L_V/P_V \leqq 0.60$.

In one embodiment, when a vertical diameter of the electron beam reaching the pixel is $D_{BV}$, the vertical diameter $D_{BV}$ and the vertical pitch $P_V$ satisfy: $0.4 < D_{BV}/P_V < 1$.

A plurality of electron emission regions may be arranged in an area corresponding to the beam-passing opening.

Alternatively, a single electron emission region may be arranged in an area corresponding to the beam-passing opening.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
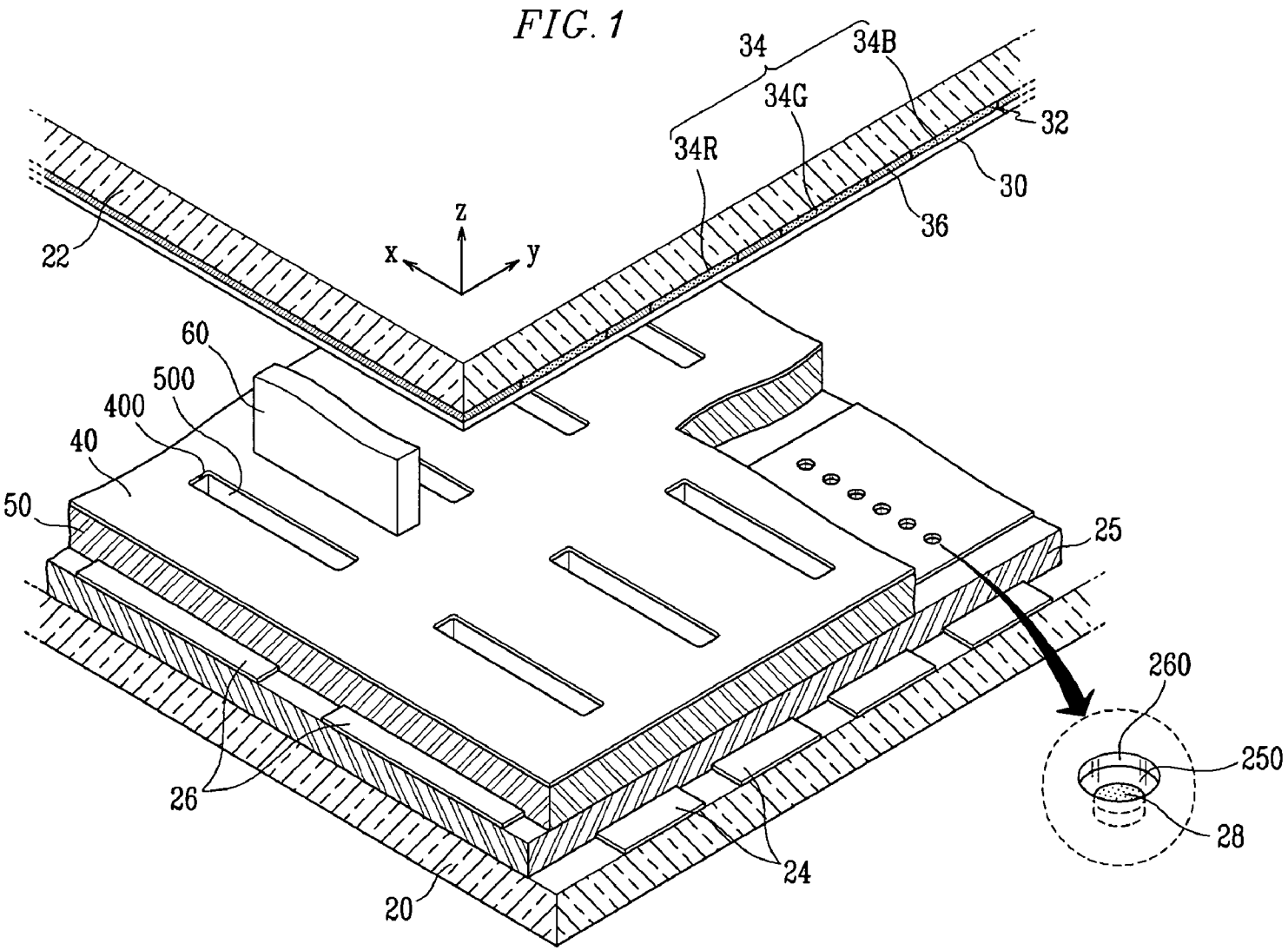
FIG. 1 is a partial perspective view of an electron emission device according to an embodiment of the present invention.
Figure 2:
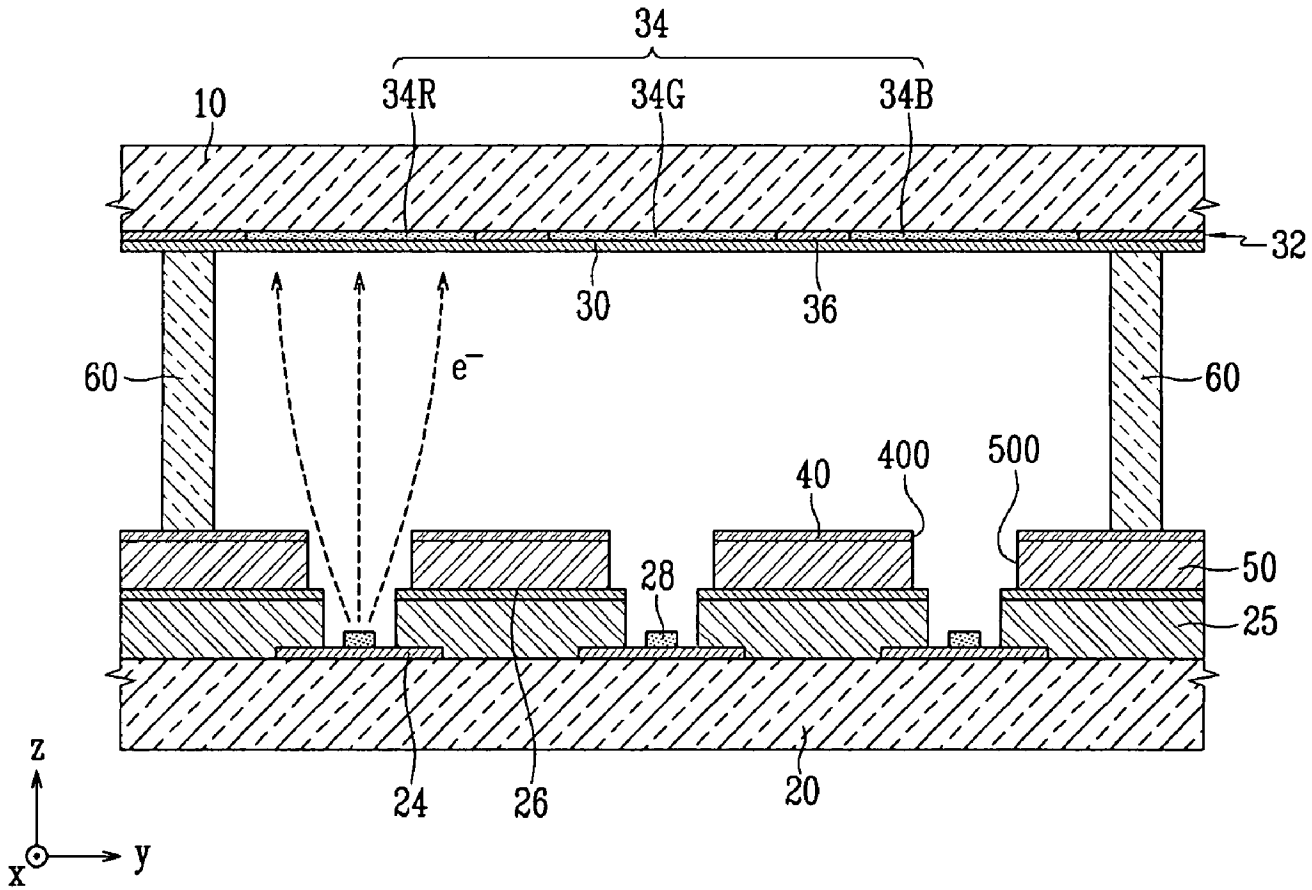
FIG. 2 is a partial sectional view of an electron emission device depicted in FIG. 1.

FIGS. 1 and 2 show an electron emission device according to an embodiment of the present invention. In this embodiment, an FEA electron emission device is provided as an example.

Referring to FIGS. 1 and 2, the FEA electron emission device includes first and second substrates 20 and 22 facing each other and spaced apart by a distance (which may be predetermined) therebetween, a plurality of first electrodes (cathode electrodes) 24 formed on the first substrate 20 and spaced apart by a distance (which may be predetermined) from each other, a plurality of second electrodes (gate electrodes) 26 crossing the first electrodes 24 on the first substrate with a first insulation layer 25 interposed therebetween, electron emission regions 28 formed on the first electrodes 26 at the crossed regions of the first electrodes 24 and the second electrodes 26, an anode electrode 30 formed on the second substrate 22, a phosphor screen 32 formed on a surface of the anode electrode 30, spacers 60 interposed between the first and second substrates 20 and 22, a focusing electrode 40 formed on the second electrodes 26 and the first insulation layer 25, and a second insulation layer 50 formed under the focusing electrode 40 to insulate the focusing electrode 40 from the second electrodes 26. Beam-passing openings 400, through which electron beams formed by electrons emitted from the electron emission regions 28 pass, are formed on the focusing electrode 40 in a predetermined pattern.

The focusing electrode 40 functions to shield an electric field of the anode electrode 30 as well as to enhance the focusing of the electron beams.

Also, beam-passing openings 500 are formed on the second insulation layer 50 disposed between the focusing electrode 4 and the second electrodes 26. A pattern of the beam-passing openings 500 formed on the second insulation layer 50 is identical (or substantially identical) to that of the beam-passing openings 400 of the focusing electrode 40.

The first and second electrodes 24 and 26, the electron emission regions 28, and the focusing electrode 40 constitute an electron emission unit for emitting the electron beams to the second substrate 22.

In addition, the anode electrode 30 and the phosphor screen 32 constitute a light emission unit for emitting light caused by the electron beams.

Describing the electron emission unit in more detail, the first electrodes 24 and the second electrodes 26 are formed in stripe patterns, which cross at right angles. For example, the first electrodes 24 are formed in the stripe pattern extending in a direction of an X-axis of FIG. 1, and the second electrodes 26 are formed in the stripe pattern extending in a direction of a Y-axis of FIG. 1.

Disposed between the first electrodes 24 and the second electrodes 26 on the first substrate 20 is the first insulation layer 25.

At the crossing regions of the first electrodes 24 and the second electrodes 26, one or more electron emission regions 28 are formed on the first electrodes 24 to correspond to each pixel region. Openings 250 and 260 corresponding to the respective electron emission regions 28 are formed in the first insulation layer 25 and the second electrodes 26 to expose the electron emission regions 28.

In this embodiment, the electron emission regions 28 are formed in a circular shape and arranged in a longitudinal direction X of each of the first electrodes 24. However, the shape, number and arrangement of the electron emission regions 28 are not limited to this embodiment.

The electron emission regions 28 may be formed with a material for emitting electrons when an electric field is applied thereto under a vacuum atmosphere, such as a carbonaceous material and/or a nanometer-size material. The electron emission regions 28 can be formed with carbon nanotubes, graphite, graphite nanofibers, diamonds, diamond-like carbon, $C_{60}$, silicon nanowires, or a combination thereof.

It is described above that the first electrodes 24 serve as the cathode electrodes while the second electrodes 26 function as the gate electrodes. However, in an alternative embodiment, first electrodes 24 may serve as the gate electrodes, and the second electrodes 26 may function as the cathode electrodes. In this alterative embodiment (not shown), electron emission regions 28 are formed on the second electrodes 26.

Describing the light emission unit in more detail, the phosphor screen 32 includes phosphor layers 34 each having red (R), green (G) and blue (B) phosphors 34R, 34G and 34B and black layers 36 arranged between the R, G and B phosphors 34R, 34G and 34B. The phosphor and black layers 34 and 36 may be formed in a pattern (which may be predetermined) for defining a plurality of pixels P (see FIG. 3).

Figure 3:
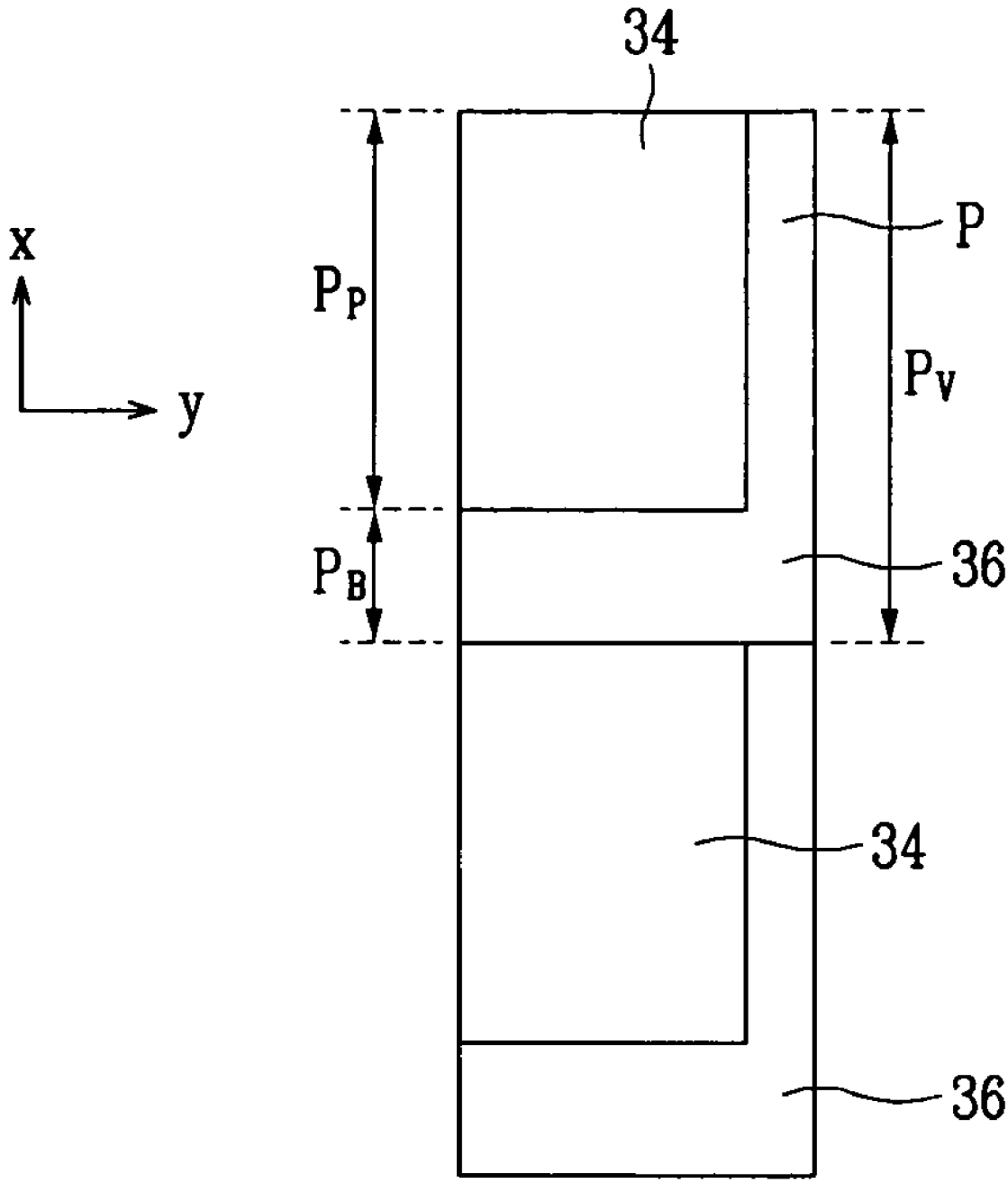
FIG. 3 is a schematic view of pixels formed on a phosphor screen of an electron emission device depicted in FIG. 1.

In this embodiment, as shown in FIG. 3, the plurality of pixels P, each having a rectangular shape, are defined by the phosphor and black layers 34 and 36. The arrangement of the pixels P corresponds to those of the beam-passing openings 400 and 500 of the focusing electrode 40 and the second insulation layer 50.

As also shown in FIG. 3, each of the pixels P has a vertical pitch $P_V$ in the longitudinal direction of the first electrode 24. The vertical pitch $P_V$ of a pixel P is the sum of a vertical pitch $P_P$ of a phosphor layer 34 and a vertical pitch $P_B$ of a black layer 36.

In this embodiment, the anode electrode 30 can be formed with a conductive material such as aluminum. The anode electrode 30 functions to heighten the screen luminance by receiving a high voltage required for accelerating the electron beams and reflecting the visible light rays radiated from the phosphor screen 32 to the first substrate 20 toward the second substrate 22, thereby heightening the screen luminance.

Alternatively, an anode electrode can be formed with a transparent conductive material, such as Indium Tin Oxide (ITO), instead of the metallic material. In this alternative case, the anode electrode is placed on the second substrate, and the phosphor screen is formed on the anode electrode (i.e., the anode electrode is between the second substrate and the phosphor screen). Here, the anode electrode includes a plurality of sections arranged in a predetermined pattern.

The first substrate 20 and the second substrate 22 having the electron emission unit and the light emission unit, respectively, are sealed together using sealant (not shown) with the interior thereof that is exhausted to form a vacuum. Here, the electron emission regions 28 face the phosphor screen 32.

In addition, the spacers 60 are arranged between the first and second substrates 20 and 22 to space the first and the second substrates 20 and 22 apart from each other with a distance (which may be predetermined) therebetween. The spacers 42 are located on non-emission regions of the electron emission device such that they do not occupy the paths of the electron beams and the related areas of the pixels P.

Figure 4:
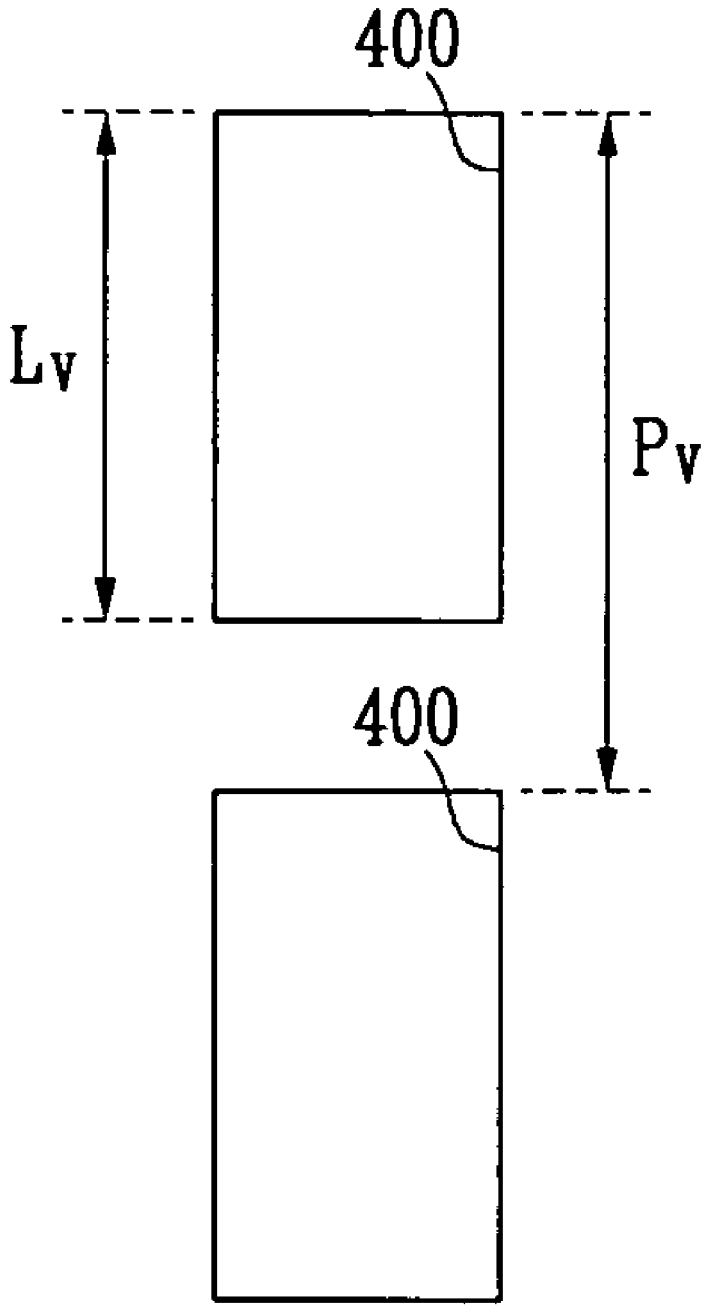
FIG. 4 is a schematic view of a beam-passing opening formed on a focusing electrode of an electron emission device depicted in FIG. 1.

In addition, a beam-passing opening 400 of the focusing electrode 40 has a vertical length $L_V$ within a range from 25 to 60% of the vertical pitch $P_V$ of the pixel P on the phosphor screen 32 (see FIG. 4).

The vertical length $L_V$ of the beam-passing opening 400 is set to be within a range where the electron beam can strike only the phosphor layer corresponding to the target pixel when it reaches the phosphor screen 32. This will now be described in more detail.

With the above structure, when a target luminance value is set at 300cd/m$^2$ and anode voltages are applied to the anode electrode 30 such that electric fields of 2.3 V/m, 2.8 V/m, 3.6 V/m, and 5.6 V/m can be formed, a plurality of measured vertical diameters $D_{BV}$ are illustrated in the following Table 1 and the graph of FIG. 5.

Here, a vertical diameter $D_{BV}$ of an electron beam is measured when it strikes a phosphor layer 34 corresponding to the target pixel P on the phosphor screen 32. An aperture ratio of the phosphor layer 34 of the phosphor screen 32 is set at 46%.

Figure 5:
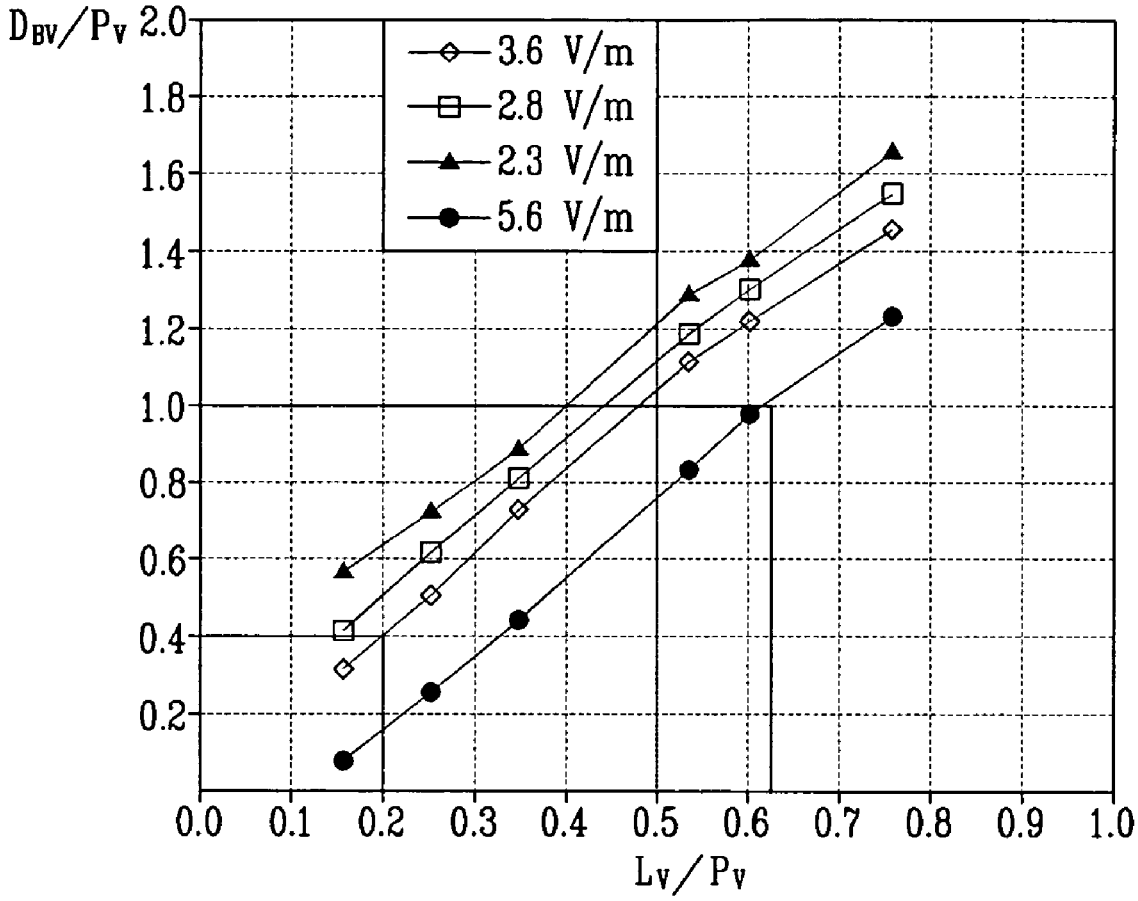
FIG. 5 is a graph of a relationship between a vertical diameter of a beam-passing opening of a focusing electrode and a vertical diameter of an electron beam in an electron emission device depicted in FIG. 1.

Particularly, Table 1 and the graph of FIG. 5 illustrate the vertical diameters $D_{BV}$ of various electron beams, which are measured as the vertical length $L_V$ of the beam-passing opening 400 varies.

In the Table 1 and the graph of FIG. 5, values are given by dividing a vertical lengths $L_V$ of abeam-passing opening 400 by a vertical pitch $P_V$ of a corresponding pixel, and a vertical diameter $D_{BV}$ of an electron beam by the vertical pitch $P_V$ of the corresponding pixel.

TABLE 1

| ITEM | | | $L_V/P_V$ | | | | | |
|---|---|---|---|---|---|---|---|---|
| | | | 0.759 | 0.601 | 0.538 | 0.348 | 0.253 | 0.158 |
| Electric Field (V/m) | 5.6 | $D_{BV}/P_V$ | 1.22 | 0.97 | 0.84 | 0.44 | 0.25 | 0.08 |
| | 3.6 | | 1.46 | 1.22 | 1.12 | 0.73 | 0.51 | 0.32 |
| | 2.8 | | 1.55 | 1.30 | 1.19 | 0.81 | 0.62 | 0.42 |
| | 2.3 | | 1.66 | 1.38 | 1.28 | 0.89 | 0.73 | 0.56 |

In order to minmize (or reduce or prevent) the electron beams from striking an unwanted pixel when they reach the target pixel (e.g., P) of the pixels arranged in a vertical direction of the phosphor screen 32, the vertical diameter $D_{BV}$ of the electron beam should be less than the vertical pitch $P_V$ of the target pixel P. That is, $D_{BV}/P_V$ is set to be less than 1.

Here, in order to realize the target luminescence value of 300 cd/m$^2$, $D_{BV}/P_V$ should be greater than 0.4. That is, the vertical pitch $P_P$ of the phosphor layer 34 is about 61% of the vertical pitch $P_V$ of the target pixel P and the vertical pitch $P_B$ of the black layer 36 is about 39%. Therefore, when the vertical diameter $D_{BV}$ of the electron beam is less than 40% of the vertical pitch $P_V$ of the target pixel P, the electron beam strikes less than ⅔ of the overall area of the phosphor layer 34. As a result, a desired luminescence may not be obtained. That is, the target luminescence value of 300 cd/m$^2$ cannot be realized. Thus, in order to realize the target luminescence value of 300 cd/m$^2$, $D_{BV}/P_V$ is set be greater than 0.4 according to an embodiment of the present invention.

Therefore, in this embodiment, the $D_{BV}/P_V$ is set to be greater than 0.4 but less than 1.0.

As shown in the Table 1 and the graph of FIG. 5, $L_V/P_V$ is within a range from 0.2 to 0.62.

When considering that there may be a measuring error in each of the above factors and a production error of an actual product, an embodiment of the present invention sets the $L_V/P_V$ to be within a range from 0.25 to 0.60.

That is, in one embodiment of the invention, the vertical length $L_V$ of the beam-passing opening 400 is within a range from 25 to 60% of the vertical pitch $P_V$ of the target pixel P.

With the above-described structure, when the electron beam emitted from the electron emission region reaches the target pixel, this beam does not excite the adjacent pixel, thereby providing the uniform resolution.

Figure 6A:
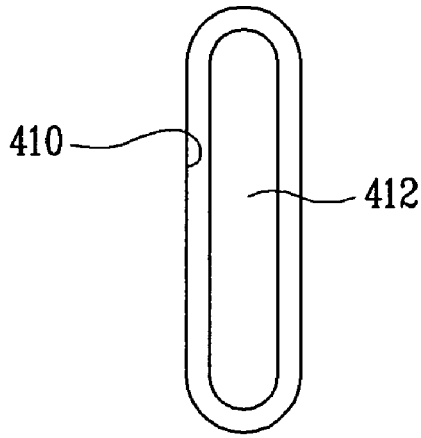
FIG. 6A is a schematic view of a first modified exemplary embodiment of a focusing electrode and electron emission regions of an electron emission device.
Figure 6B:
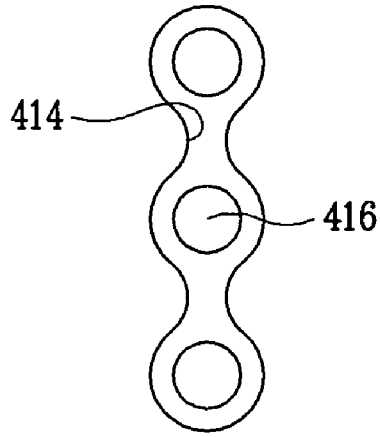
FIG. 6B is a schematic view of a second modified exemplary embodiment of a focusing electrode and electron emission regions of an electron emission device.
Figure 6C:
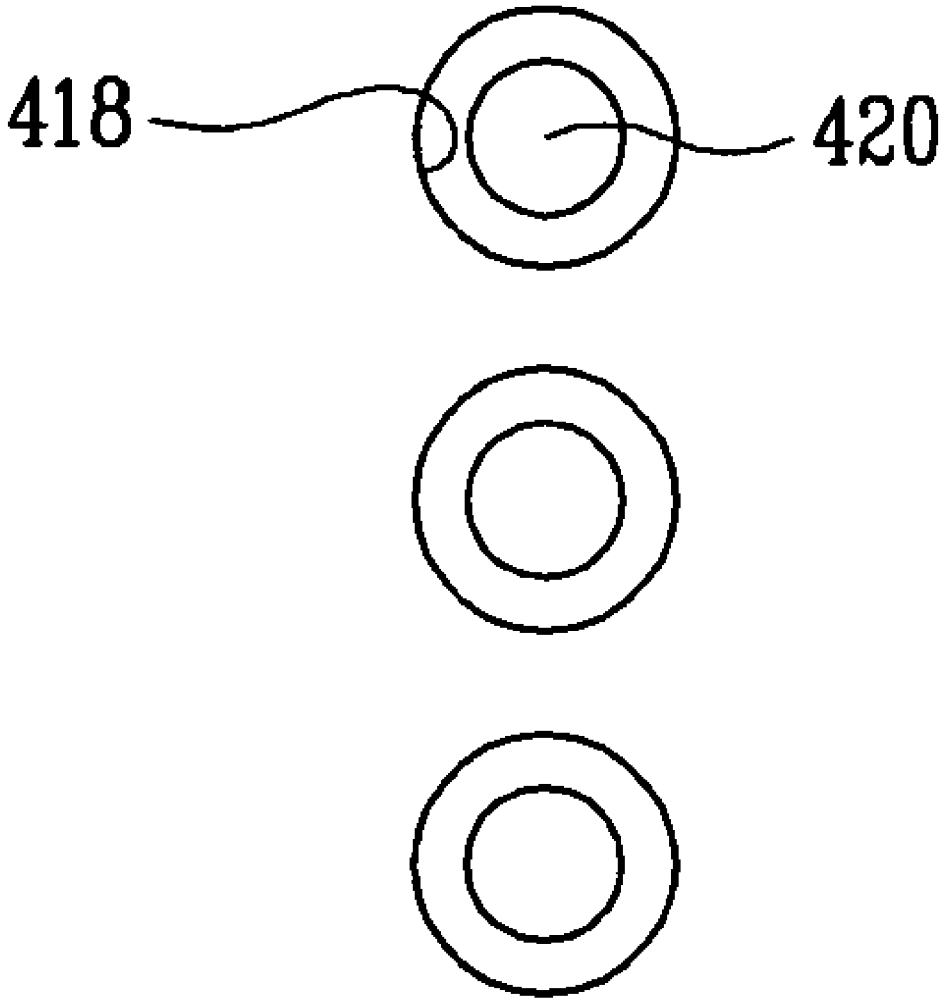
FIG. 6C is a schematic view of a third modified exemplary embodiment of a focusing electrode and electron emission regions of an electron emission device.

FIGS. 6A through 6C show patterns of the beam-passing openings of the focusing electrode and the electron emission regions according to various embodiments of the invention.

Referring first to FIG. 6A, beam-passing openings 410 of a focusing electrode are arranged in a vertical direction of pixels formed on a phosphor screen and a single electron region 412 is arranged to correspond to a single beam-passing opening 410. In FIG. 6A, a pattern of the electron emission regions 412 may be similar to that of the beam-passing openings 410.

Referring to FIG. 6B, a plurality of electron emission regions 416 are arranged to correspond to a single beam-passing opening 414.

Referring to FIG. 6C, a beam-passing opening includes a series of holes 418 and a single electron emission region 420 arranged to correspond to each of the holes 418.

In the above-described embodiments of FIGS. 6A, 6B, and 6C, the beam-passing openings 410, 414 and 418 are arranged to correspond to the pixels of the phosphor screen. Here, each of the beam-passing openings 410, 414 and 418 is designed to fulfill the above-described conditions.

Figure 7:
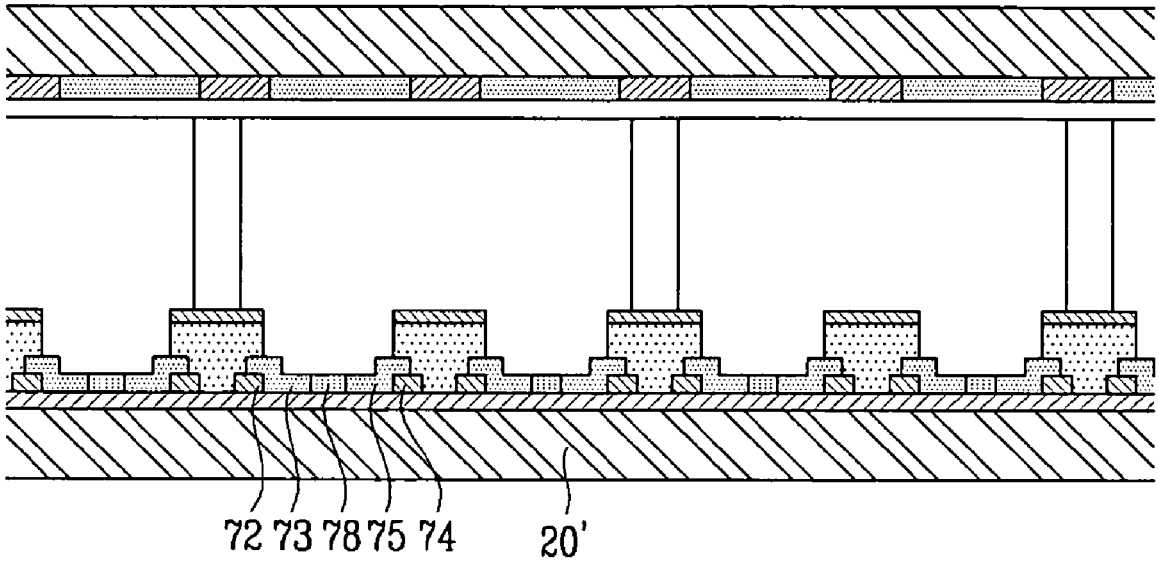
FIG. 7 is a sectional view of an electron emission device according to another embodiment of the present invention.
Figure 8:
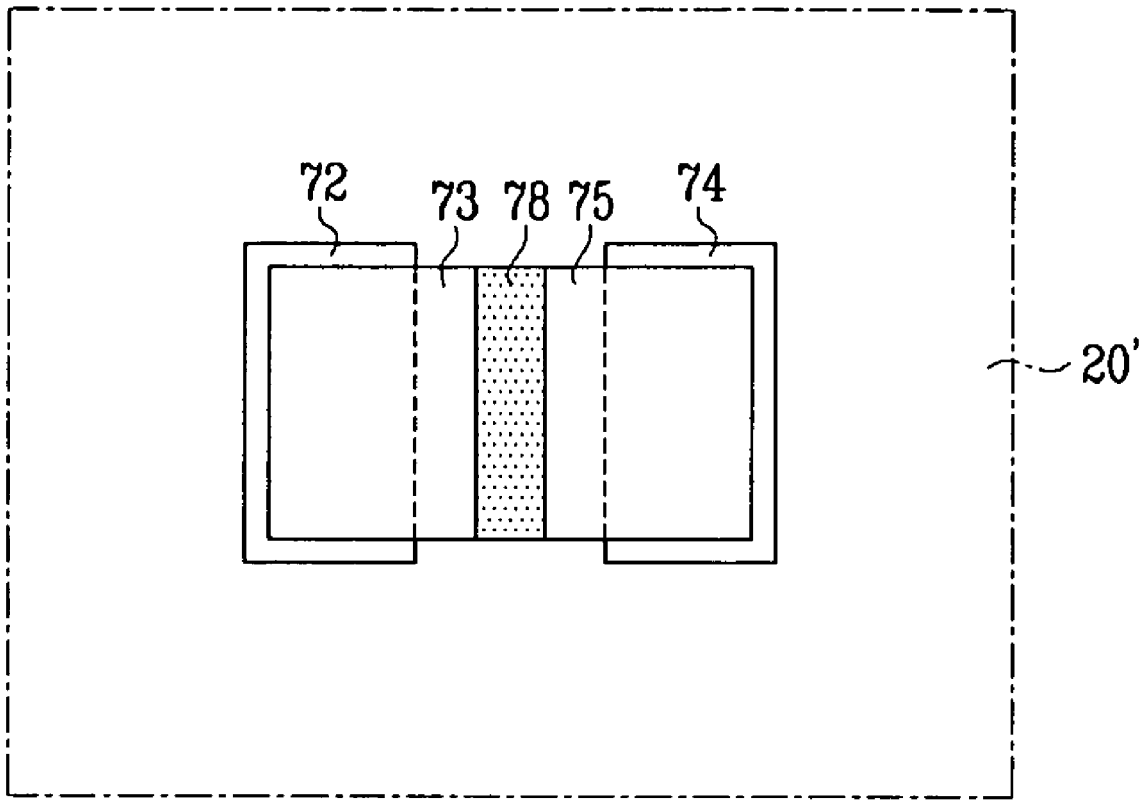
FIG. 8 is a partial enlarged top view of an electron emission region of an electric emission device of FIG. 7.

FIGS. 7 and 8 show an electron emission device according to another embodiment of the present invention. In this embodiment, an SCE electron emission device is exampled.

As shown in FIGS. 7 and 8, the SCE electron emission device includes first and second electrodes 72 and 74 that are formed on an identical planes of a first substrate 20'. First and second conductive thin films 73 and 75 are placed close to each other while partially covering the surface of the first and the second electrodes 72 and 74.

Electron emission regions 78 are arranged between and connected to the first and the second conductive thin films 73 and 75. Therefore, the electron emission regions 78 are electrically connected to the first and second electrodes 72 and 73 via the first and second conductive thin films 73 and 75.

When a driving voltage is applied to the first and second electrodes 72 and 74, a surface conduction electron emission is realized as the current horizontally flows along a surface of the electron emission regions 78 through the first and second conductive thin films 73 and 75.

A distance between the first and second electrodes 72 and 74 is set to be within a range of tens of nm to hundreds of μm.

The first and the second electrodes 72 and 74 can be formed with various conductive materials such as Ni, Cr, Au, Mo, W, Pt, Ti, Al, Cu, Pd, Ag, and alloys thereof. Alternatively, the first and second electrodes 72 and 74 can be printed conductive electrodes formed with metal oxide or transparent electrodes formed with ITO. The first and the second conductive thin films 73 and 75 can be formed with micro particles based on a conductive material, such as nickel, gold, platinum, and/or palladium. The electron emission regions 78 can be formed with a carbonaceous material and/or a nanometer-size material. The electron emission regions 38 can be formed with graphite, diamonds, diamond-like carbon, carbon nanotubes, $C_{60}$, or a combination thereof.

The other parts that are not described in this embodiment are substantially the same as the embodiments already described above, and a detailed description thereof will not be described in more detail.

Furthermore, the other parts that are not described in any of the above embodiments may be realized with any suitable structures of the FEA and/or SCE electron emission devices.

According to the present invention, since a vertical length of a beam-passing opening is set within a proper range in which an electron beam does not strikes an adjacent non-targeted pixel, the uniformity of a resolution can be improved by minimizing (or reducing or preventing) the electron beam from striking and exciting the adjacent non-targeted pixel.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a first substrate;

a second substrate facing the first substrate and spaced apart from the first substrate;

an electron emission unit formed on the first substrate, the electron emission unit having a first electrode, a second electrode, and an electron emission region for emitting electrons; and a light emission unit formed on the second substrate and adapted to be excited by an electron beam formed with the electrons;

wherein the electron emission unit includes a focusing electrode for focusing the electron beam;

wherein the light emission unit includes a phosphor screen on which a plurality of pixels are arranged in a pattern, each of the pixels having a phosphor layer, the phosphor layer of at least one of the pixels being adapted to be excited by the electron beam; and wherein the focusing electrode includes a beam-passing opening, through which the electron beam passes, and, when a vertical length of the beam-passing opening is $L_V$ and a vertical pitch of at least one of the pixels is $P_V$, the vertical length $L_V$ and the vertical pitch $P_V$ satisfy:

$$0.25 \leqq L_V/P_V \leqq 0.60.$$

2. The electron emission device of claim 1, wherein when a vertical diameter of the electron beam reaching the pixel is $D_{BV}$, the vertical diameter $D_{BV}$ and the vertical pitch $P_V$ satisfy:

$$0.4 < D_{BV}/P_V < 1.$$

3. The electron emission device of claim 2, wherein a plurality of electron emission regions are arranged in an area corresponding to the beam-passing opening.

4. The electron emission device of claim 2, wherein a single electron emission region is arranged in an area corresponding to the beam-passing opening.

5. The electron emission device of claim 1, wherein a plurality of electron emission regions are arranged in an area corresponding to the beam-passing opening.

6. The electron emission device of claim 1, wherein a single electron emission region is arranged in an area corresponding to the beam-passing opening.

7. The electron emission device of claim 1, wherein the first electrode is a cathode electrode and the second electrode is a gate electrode.

8. An electron emission device comprising:

a first substrate;

a second substrate facing the first substrate and spaced apart from the first substrate;

an electron emission unit formed on the first substrate, the electron emission unit having a first electrode, a second electrode, and an electron emission region for emitting electrons; and a light emission unit formed on the second substrate and adapted to be excited by an electron beam formed with the electrons;

wherein the electron emission unit includes a focusing electrode for focusing the electron beam;

wherein the light emission unit includes a phosphor screen on which a plurality of pixels are arranged in a pattern, each of the pixels having a phosphor layer, the phosphor layer of at least one of the pixels being adapted to be excited by the electron beam;

wherein the focusing electrode includes a beam-passing opening, through which the electron beam passes, and, when a vertical length of the beam-passing opening is $L_V$ and a vertical pitch of at least one of the pixels is $P_V$, the vertical length $L_V$ and the vertical pitch $P_V$ satisfy:

$$0.20 \leqq L_V/P_V \leqq 0.62.$$

9. The electron emission device of claim 8, wherein when a vertical diameter of the electron beam reaching the pixel is $D_{BV}$, the vertical diameter $D_{BV}$ and the vertical pitch $P_V$ satisfy:

$$0.4 < D_{BV}/P_V < 1.$$

10. The electron emission device of claim 9, wherein a plurality of electron emission regions are arranged in an area corresponding to the beam-passing opening.

11. The electron emission device of claim 9, wherein a single electron emission region is arranged in an area corresponding to the beam-passing opening.

12. The electron emission device of claim 8, wherein a plurality of electron emission regions are arranged in an area corresponding to the beam-passing opening.

13. The electron emission device of claim 8, wherein a single electron emission region is arranged in an area corresponding to the beam-passing opening.

14. An electron emission device comprising:

a first substrate;

a second substrate facing the first substrate and spaced apart from the first substrate;

an electron emission unit formed on the first substrate, the electron emission unit having a first electrode, a second electrode, and an electron emission region for emitting electrons; and a light emission unit formed on the second substrate and adapted to be excited by an electron beam formed with the electrons;

wherein the electron emission unit includes a focusing electrode for focusing the electron beam;

wherein the light emission unit includes a phosphor screen on which a plurality of pixels are arranged in a pattern, each of the pixels having a phosphor layer, the phosphor layer of at least one of the pixels being adapted to be excited by the electron beam;

wherein the focusing electrode includes a beam-passing opening, through which the electron beam passes, and, when a vertical diameter of the electron beam reaching the pixel is $D_{BV}$ and a vertical pitch of at least one of the pixels is $P_V$, the vertical diameter $D_{BV}$ and the vertical pitch $P_V$ satisfy:

$$0.4<D_{BV}/P_V<1.$$

15. The electron emission device of claim 14, wherein a plurality of electron emission regions are arranged in an area corresponding to the beam-passing opening.

16. The electron emission device of claim 14, wherein a single electron emission region is arranged in an area corresponding to the beam-passing opening.

* * * * *